US007707030B2

(12) United States Patent
Edler et al.

(10) Patent No.: US 7,707,030 B2
(45) Date of Patent: Apr. 27, 2010

(54) DEVICE AND METHOD FOR GENERATING A COMPLEX SPECTRAL REPRESENTATION OF A DISCRETE-TIME SIGNAL

(75) Inventors: Bernd Edler, Hannover (DE); Stefan Geyersberger, Wuerzburg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 578 days.

(21) Appl. No.: 11/044,786

(22) Filed: Jan. 26, 2005

(65) Prior Publication Data

US 2005/0197831 A1 Sep. 8, 2005

Related U.S. Application Data

(63) Continuation of application No. PCT/EP03/07608, filed on Jul. 14, 2003.

(30) Foreign Application Priority Data

Jul. 26, 2002 (DE) ..... 102 34 130

(51) Int. Cl.
*G10L 19/14* (2006.01)

(52) U.S. Cl. ..... 704/211; 704/203; 704/230; 704/200.1

(58) Field of Classification Search ..... 704/226–230, 704/200.1, 205, 201, 203, 500–504, 211, 704/222
See application file for complete search history.

(56) References Cited

U.S. PATENT DOCUMENTS 5,727,119 A 3/1998 Davidson et al. ..... 395/2.12
5,839,101 A * 11/1998 Vahatalo et al. ..... 704/226
5,890,106 A 3/1999 Bosi-Goldberg ..... 704/203
7,343,287 B2 * 3/2008 Geiger et al. ..... 704/230

FOREIGN PATENT DOCUMENTS

DE 696 03 166 3/1996

OTHER PUBLICATIONS

Vinton, M.S.; Atlas, L.E., "Scalable and progressive audio codec" Acoustics, Speech, and Signal Processing, 2001. Proceedings. (ICASSP '01). 2001 IEEE International Conference on vol. 5, May 7-11, 2001 pp. 3277-3280 vol. 5.*

(Continued)

*Primary Examiner*—Huyen X. Vo
(74) *Attorney, Agent, or Firm*—Michael A. Glenn; Glenn Patent Group

(57) ABSTRACT

A filter bank device for generating a complex spectral representation of a discrete-time signal includes a generator for generating a block-wise real spectral representation, which, for example, implements an MDCT, to obtain temporally successive blocks of real spectral coefficients. The output values of this spectral conversion device are fed to a post-processor for post-processing the block-wise real spectral representation to obtain an approximated complex spectral representation having successive blocks, each block having a set of complex approximated spectral coefficients, wherein a complex approximated spectral coefficient can be represented by a first partial spectral coefficient and by a second partial spectral coefficient, wherein at least one of the first and second partial spectral coefficients is determined by combining at least two real spectral coefficients. A good approximation for a complex spectral representation of the discrete-time signal is obtained by combining two real spectral coefficients, preferably by a weighted linear combination, wherein additionally more degrees of freedom for optimizing the entire system are available.

22 Claims, 4 Drawing Sheets

OTHER PUBLICATIONS

Berg, A. and W. Mikhael; A Survey of Mixed Transform Techniques for Speech and Image Coding; 1999; IEEE.

Karp, T. and N. Fliege; MDFT Filter Banks with Perfect Reconstruction; 1005; IEEE.

Karp, T. and N. Fliege; Modified DFT Filter Banks with Perfect Reconstruction; 1999; IEEE.

Malvar, Henrique; A Modulated Complex Lapped Transform and its Applications to Audio Processing; 1999; IEEE.

Princen, J. and A. Bradley; Analysis/Synthesis Filter Bank Design Based on Time Domain Aliasing Cancellation; 1986; IEEE.

Vinton, M. and L. Atlas; A Scalable and Progressive Audio Codec; 2001; IEEE.

ISO/IEC 11172-3: 1993 (E).

* cited by examiner $h_L(m)=\{1,1\}$
$h_H(m)=\{1,-1\}$ $h_R(m)=\{0,1,0\}$; $h_A(m)=\{a,-b,a\}$
$h_B(m)=\{c,0,-c\}$; $h_C(m)=\{a,b,a\}$

DEVICE AND METHOD FOR GENERATING A COMPLEX SPECTRAL REPRESENTATION OF A DISCRETE-TIME SIGNAL

CROSS-REFERENCE TO RELATED APPLICATION

This application is a continuation of copending International Application No. PCT/EP03/07608, filed Jul. 14, 2003, which designated the United States and was not published in English, and is incorporated herein by reference in its entirety.

BACKGROUND OF THE INVENTION

1. Field of the Invention

The present invention relates to time-frequency conversion algorithms and, in particular, to such algorithms in connection with audio compression concepts.

2. Description of the Related Art

A representation of real-valued discrete-time signals in the form of complex-valued spectral components is required for some applications when coding for the purpose of compressing data and, in particular, when audio-coding. A complex spectral coefficient can be represented by a first and second partial spectral coefficients, wherein, as is desired, the first partial spectral coefficient is the real part and the second partial spectral coefficient is the imaginary part. Alternatively, the complex spectral coefficient can also be represented by the magnitude as the first partial spectral coefficient and the phase as the second partial spectral coefficient.

In particular in audio-coding, real-valued transform methods are frequently employed, such as, for example, the well-known MDCT described in "Analysis/Synthesis Filter Bank Design Based on Time Domain Aliasing Cancellation", J. Princen, A. Bradley, IEEE Trans. Acoust., Speech, and in Signal Processing 34, pp. 1153-1161, 1986. There is, for example, demand for a complex spectrum in a psycho-acoustic model. Here, reference is made to the psycho-acoustic model in Annex D.2.4 of the standard ISO/IEC 11172-3 which is also referred to as the MPEG1 standard. In certain applications, a complex discrete Fourier transform is performed in parallel to the actual MDCT transform (MDCT=modified discrete cosine transform) to calculate psycho-acoustic parameters, such as, for example, the psycho-acoustic masking threshold.

In this discrete Fourier transform (DFT), the input signal is at first divided into blocks of a predetermined length by means of a multiplication by temporally offset window functions. Each of these blocks is subsequently transformed into a spectral representation by applying the DFT. If the blocks used each contain L samples, i.e. if the window length is L, the output of the DFT in turn can be described completely in the form of L values altogether (real and imaginary parts of magnitude and phase values). If, for example, the input signal is real, the result will be L/2 complex values. With this usage of suitable window functions, the input signal can be reconstructed again from this representation using an inverse DFT.

This approach, however, is subject to some limitations. A critical sampling, for example, will only be possible if successive windows do not overlap. Otherwise, L values in the spectral representation would have to be transferred with a temporal offset of N<L values for N respective new input values of the DFT, which is particularly undesired in data compression methods.

The usage of non-overlapping window functions, however, means a severe limitation of the achievable spectral splitting quality, wherein especially the separation of different frequency bands is to be mentioned.

An improved band separation, however, can be achieved with real-valued transforms having overlapping window functions. A special class of these transforms are the so-called modulated filter banks including the possibility of an efficient implementation. Among these modulated filter banks, the modified discrete cosine transform (MDCT) has become predominant as a special form, where the window length L can take values between N and 2N−1 due to different degrees of overlapping.

FIG. 6 shows the separation of a discrete-time input signal x(n) into the spectral components $u_{k,m}$, m representing the temporal block index, i.e. the time index after the sampling rate reduction, whereas k is the frequency index or sub-band index. The sampling frequencies are the same in all the sub-bands, i.e. the original sampling frequency is reduced by the factor N. The filter bank illustrated in FIG. 6 having filters 60 and downstream down-sampling elements 62 provides a uniform band separation.

In a modulated filter bank, the individual sub-band filters are formed by multiplying a prototype impulse response $h_p(n)$ by a sub-band-specific modulation function, wherein the following rule is used for the MDCT and similar transforms:

$$h_k(n) = h_p(n)\cos\left(\frac{\pi}{N}\left(n - \frac{N}{2} + \frac{1}{2}\right)\left(k + \frac{1}{2}\right)\right)$$

The above transform rule can also differ from the above equation, e.g. when the sine function instead of the cosine function is used or when "+N/2" is used instead of "−N/2". Even the usage in an alternating MDCT/MDST, which will be explained hereinafter (when using k instead of k+1/2), is feasible.

In the above equation, $h_p(n)$ is the prototype impulse response. $h_k(n)$ is the filter impulse response for the filter associated to the sub-band k. n is the count index of the discrete-time input signal x(n), whereas N indicates the number of spectral coefficients.

The output value of a real-valued transform, such as, for example, the MDCT, which, as is well-known, is not energy-conserving, can only be employed for applications requiring complex-valued spectral components under certain circumstances. If, for example, the magnitudes of the real output values are used as an approximation for the magnitudes of complex-valued spectral components in the corresponding frequency domains, a result will be strong variations even with sine input signals having a constant amplitude. Such a procedure correspondingly provides bad approximations for short-term magnitude spectra of the input signal.

In the publication "A Scalable and Progressive Audio Codec", Vinton and Atlas, IEEE ICASSP 2001, 7-11 May 2001, Salt Lake City, an audio coder having a transform algorithm including a base transform and a second transform is illustrated. The input signal is windowed by a Kaiser-Bessel window function to generate temporally successive blocks of sample values. The blocks of input values are then transformed either by means of a modified discrete cosine transform (MDCT) or by means of a modified discrete sine transform (MDST), depending on a shift index. This base transform process basically corresponds to the TDAC filter bank described in the cited publication by Princen and Bradley. Two temporally successive blocks of spectral coefficients are combined into a single complex transform such that the MDCT block represents the real parts of complex spectral coefficients, whereas the temporally successive MDST block represents the pertaining imaginary parts of the complex spectral coefficients. A time-frequency distribution of the magnitude of the complex spectrum is generated from this, wherein a two-dimensional magnitude distribution over time in each frequency band is windowed by means of window functions overlapping by 50%. Subsequently, a magnitude matrix is calculated by means of the second transform. The phase information is not subjected to the second transform.

The alternating usage of the output values of an MDCT as the real part and the imaginary part is also introduced as "MDFT" in the publication "MDCT Filter Banks with Perfect Reconstruction", Karp and Fliege, Proc. IEEE ISCAS 1995, Seattle.

It has been found out that even this approximation of a complex spectrum from a real-valued spectral representation of the discrete-time input signal is problematic in that an adequate magnitude representation cannot be obtained for sounds of certain frequencies. Determining short-term magnitude spectra is thus only possible with this transform to a limited extent.

SUMMARY OF THE INVENTION

It is the object of the present invention to provide an improved concept for generating a complex spectral representation of a discrete-time signal.

In accordance with a first aspect, the present invention provides a device for generating a complex spectral representation of a discrete-time signal, having: means for generating a block-wise real-valued spectral representation of the discrete-time signal, the spectral representation having temporally successive blocks, each block having a set of real spectral coefficients; and means for post-processing the block-wise real-valued spectral representation to obtain a block-wise complex approximated spectral representation having successive blocks, each block having a set of complex approximated spectral coefficients, wherein a complex approximated spectral coefficient can be represented by a first partial spectral coefficient and a second partial spectral coefficient, wherein at least one of the first and the second partial spectral coefficients is to be determined by combining at least two temporally and/or frequency-adjacent real spectral coefficients.

In accordance with a second aspect, the present invention provides a method for generating a complex spectral representation of a discrete-time signal, having the steps of: generating a block-wise real-valued spectral representation of the discrete-time signal, the spectral representation having temporally successive blocks, each block having a set of real spectral coefficients; and post-processing the block-wise real-valued spectral representation to obtain a block-wise complex approximated spectral representation having successive blocks, each block having a set of complex approximated spectral coefficients, wherein a complex approximated spectral coefficient can be represented by a first partial spectral coefficient and a second partial spectral coefficient, wherein at least one of the first and second partial spectral coefficients is to be determined by combining at least two temporally and/or frequency-adjacent real spectral coefficients.

In accordance with a third aspect, the present invention provides a device for coding a discrete-time signal, having: means for generating a block-wise real-valued spectral representation of the discrete-time signal, the spectral representation having temporally successive blocks, each block having a set of real spectral coefficients; a psycho-acoustic module for calculating a psycho-acoustic masking threshold depending on the discrete-time signal; means for quantizing a block of real-valued spectral coefficients using the psycho-acoustic masking threshold, wherein the psycho-acoustic module having means for post-processing the block-wise real spectral representation to obtain a block-wise complex approximated spectral representation having successive blocks, each block having a set of complex approximated spectral coefficients, wherein a complex approximated spectral coefficient can be represented by a first partial spectral coefficient and a second partial spectral coefficient, wherein at least one of the first and second partial spectral coefficients is to be determined by combining at least two temporally and/or frequency-adjacent real spectral coefficients.

In accordance with a fourth aspect, the present invention provides a method for coding a discrete-time signal, having the steps of: generating a block-wise real-valued spectral representation of the discrete-time signal, the spectral representation having temporally successive blocks, each block having a set of real spectral coefficients; calculating a psycho-acoustic masking threshold depending on the discrete-time signal; quantizing a block of real-valued spectral coefficients using the psycho-acoustic masking threshold, wherein a step of post-processing the block-wise real spectral representation is performed in the step of calculating to obtain a block-wise complex approximated spectral representation having successive blocks, each having a set of complex approximated spectral coefficients, wherein a complex approximated spectral coefficient can be represented by a first partial spectral coefficient and a second partial spectral coefficient, wherein at least one of the first and second partial spectral coefficients is to be determined by combining at least two temporally and/or frequency-adjacent real spectral coefficients.

In accordance with a fifth aspect, the present invention provides a device for generating a real spectral representation from a complex approximated spectral representation, the real spectral representation to be determined having temporally successive blocks, each block having a set of real spectral coefficients, the complex approximated spectral representation having temporally successive blocks, each block having a set of complex approximated spectral coefficients, wherein a complex approximated spectral coefficient can be represented by a first partial spectral coefficient and a second partial spectral coefficient, the complex approximated spectral coefficients having been calculated by a transform rule from the real spectral coefficients, the transform rule including a combination of at least two temporally and/or frequency-adjacent real spectral coefficients to calculate at least one of the first and second partial spectral coefficients of a complex approximated spectral coefficient, having: means for performing a combining rule inverse to the transform rule to calculate the real spectral coefficients from the complex approximated spectral coefficients.

In accordance with a sixth aspect, the present invention provides a method for generating a real spectral representation of a complex approximated spectral representation, the real spectral representation to be determined having temporally successive blocks, each block having a set of real spectral coefficients, the complex approximated spectral representation having temporally successive blocks, each block having a set of complex approximated spectral coefficients, wherein a complex approximated spectral coefficient can be represented by a first partial spectral coefficient and a second partial spectral coefficient, the complex approximated spectral coefficients having been calculated by a transform rule from the real spectral coefficients, the transform rule including a combination of at least two temporally and/or frequency-adjacent real spectral coefficients to calculate at least one of the first and second partial spectral coefficients of a complex approximated spectral coefficient, having the step of: performing a combination rule inverse to the transform rule to calculate the real spectral coefficients from the complex approximated spectral coefficients.

In accordance with a seventh aspect, the present invention provides a computer program having a program code for performing one of the above-mentioned methods, when the program runs on a computer.

The present invention is based on the finding that a good approximation for a spectral representation of a discrete-time signal can be determined from a block-wise real-valued spectral representation of the discrete-time signal by calculating a first partial spectral coefficient and/or a second partial spectral coefficient by combining at least two real spectral coefficients. Thus, the real part or the imaginary part of an approximated complex spectral coefficient for a certain frequency index is, for example, obtained by combining two or more real spectral coefficients, preferably in temporal and/or frequency proximity to the complex spectral coefficient to be calculated. Preferably, the combination is a linear combination, wherein the real spectral coefficients to be combined can also be weighted before the linear combination, i.e. an addition or subtraction, by means of constant weighting factors.

It is to be pointed out here that a linear combination is an addition or a subtraction of different linear combination partners which may be weighted or not by means of weighting factors before the linear combination. The weighting factors can be positive or negative real numbers including zero.

In a preferred embodiment of the present invention, the two or more real spectral coefficients which are combined to obtain a complex partial spectral coefficient for a frequency index and a (temporal) block index, are arranged in frequency and/or temporal proximity. Real spectral coefficients having a frequency index higher by 1 or lower by 1 from the current (temporal) block are in frequency proximity. In addition, the corresponding real spectral coefficients from the directly preceding temporal block or from the directly following temporal block having the same frequency index are in temporal proximity. Furthermore, real spectral coefficients of the directly preceding or the directly following temporal block having a frequency index which is higher or lower by one frequency index than the frequency index of the partial spectral coefficients being calculated are in both temporal and frequency proximity.

Preferably, the combining rule for calculating a partial spectral coefficient varies depending on whether the frequency index is even or odd.

It has been found out according to the invention that a combination of real spectral coefficients in temporal and/or frequency proximity to the complex spectral coefficient to be determined provides a good approximation to a desired frequency response of the entire assembly from the means for generating a block-wise real-valued spectral representation and the means for post-processing the block-wise real-valued representation, wherein the frequency response—usually having a band-pass characteristic—is to have a desired course for positive frequencies and should be as small as possible or 0 for negative frequencies. Such a frequency response is the result of the inventive concept and is thought to be of advantage in many applications.

In preferred embodiments, the characteristics of this frequency response can be manipulated, for example, by suitably setting the weighting factors or by correspondingly modifying the window functions of the first transform to generate the real-valued spectral coefficients. Thus, the system provides many degrees of freedom for adjustment to certain demands, wherein particularly the possibility of combining not only two real spectral coefficients but more than two real spectral coefficients to obtain an even better approximation to a desired frequency response of the entire assembly should be mentioned.

BRIEF DESCRIPTION OF THE DRAWINGS

Preferred embodiments of the present invention will be explained in greater detail subsequently referring to the appendage drawings, in which.

DESCRIPTION OF PREFERRED EMBODIMENTS

Figure 1:
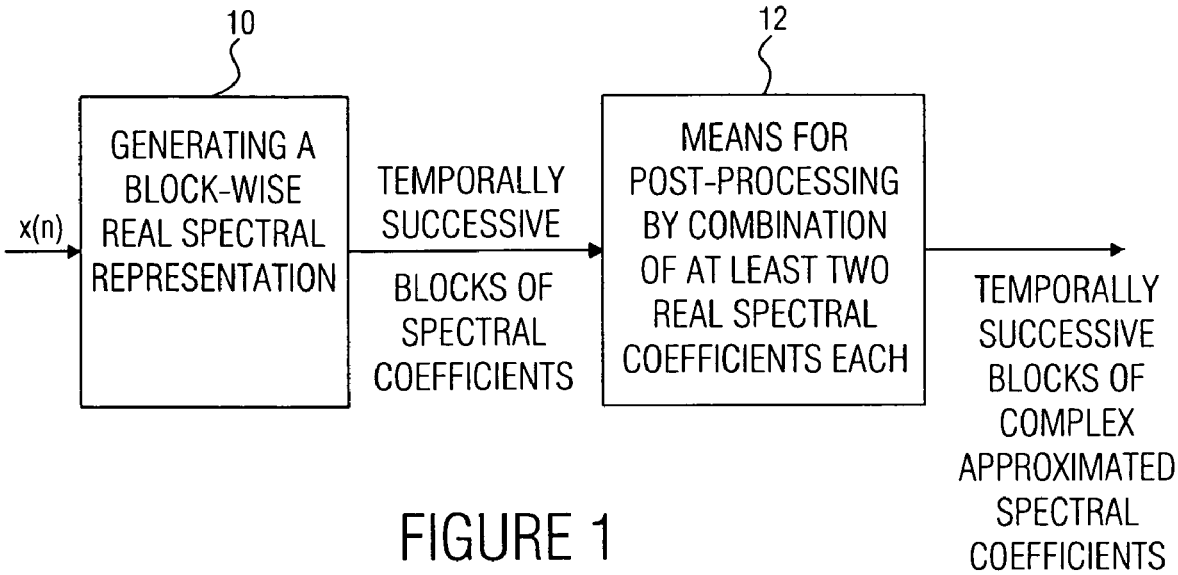
FIG. 1 shows a block diagram of the inventive device for generating a complex spectral representation.

FIG. 1 shows a device for generating a complex spectral representation of a discrete-time signal x(n). The discrete-time signal x(n) is fed to means 10 for generating a block-wise real-valued spectral representation of the discrete-time signal, the spectral representation comprising temporally successive blocks, each block comprising a set of spectral coefficients, as will be discussed in greater detail referring to FIGS. 2*a* and 2*b*. At the output of means 10, there is a sequence of temporally successive blocks of spectral coefficients which, due to the characteristic of means 10, are real-valued spectral coefficients. This sequence of temporally successive blocks of spectral coefficients is fed to means 12 for post-processing to obtain a block-wise complex approximated spectral representation comprising successive blocks, each block comprising a set of complex approximated spectral coefficients, wherein a complex approximated spectral coefficient can be represented by a first partial spectral coefficient and a second spectral coefficient, at least one of the first and second spectral coefficients being determined by combining at least two real spectral coefficients.

Figure 2A:
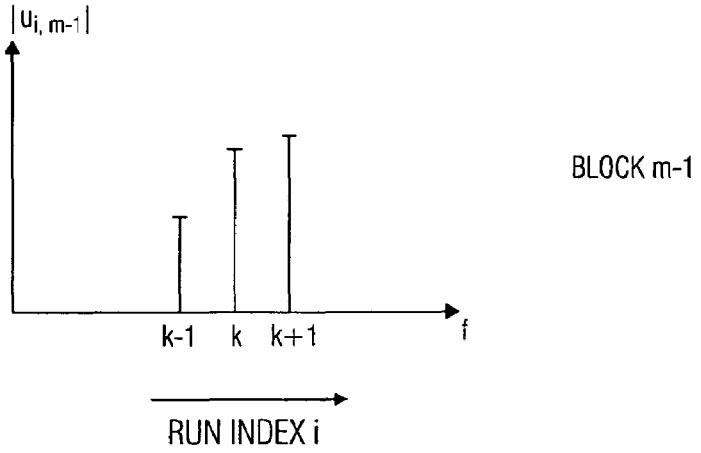
FIGS. 2*a* to 2*c* show an illustration of the real spectral coefficients adjacent to a partial spectral component for a complex spectral coefficient having a frequency index of k and a block index of m.
Figure 2B:
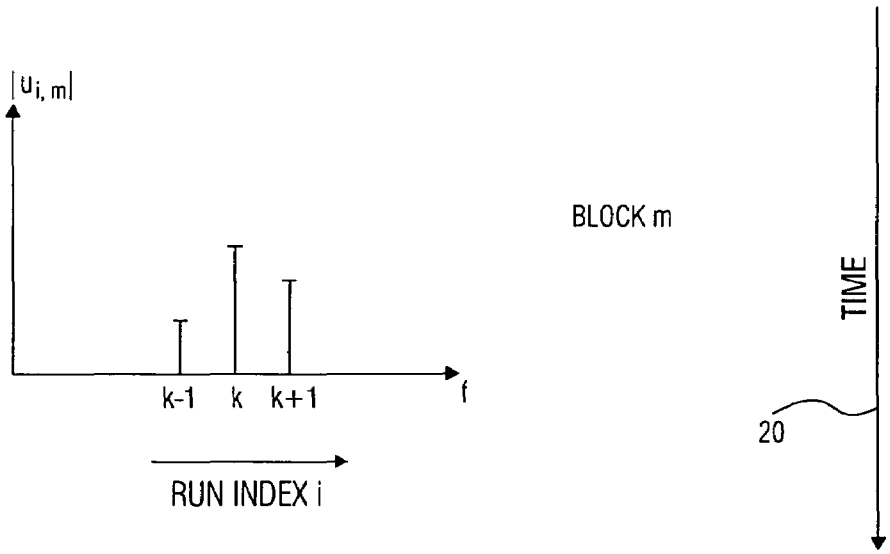
Figure 2C:
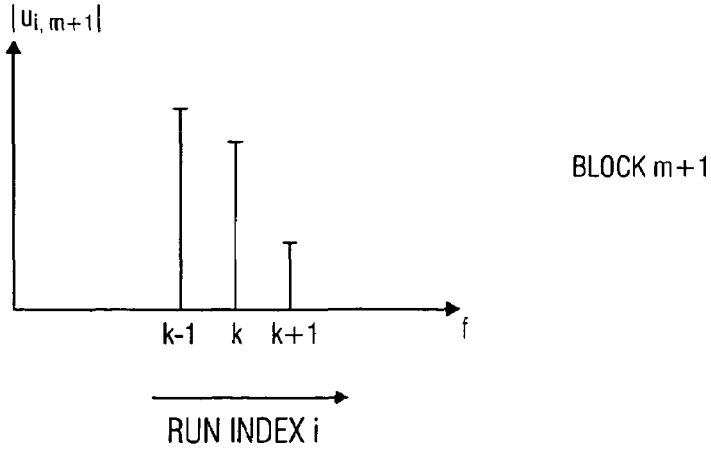

FIGS. 2*a* to 2*c* together show a sequence of blocks of magnitudes of real-valued spectral coefficients as are generated by means 10 of FIG. 1. m represents a block index, whereas k represents a frequency index. FIG. 2 shows a block, indicated along the frequency axis, of real-valued spectral coefficients at the time or block index (m−1). The block of spectral coefficients includes spectral coefficients $u_{i,m-1}$, i being a run index, whereas m−1 represents the block index. In particular, a spectral line having a frequency index i=k and a spectral component having a frequency index i=(k−1) and i=(k+1) are shown in FIG. 2*a*.

FIG. 2*b* shows the same situation but for the temporally successive block m. Finally, FIG. 2*c* again shows the same situation but for the block index (m+1). Thus, in the sequence of FIGS. 2*a*, 2*b*, 2*c*, the result is a temporal course symbolized in FIGS. 2*a* to 2*c* by an arrow 20.

Figure 3:
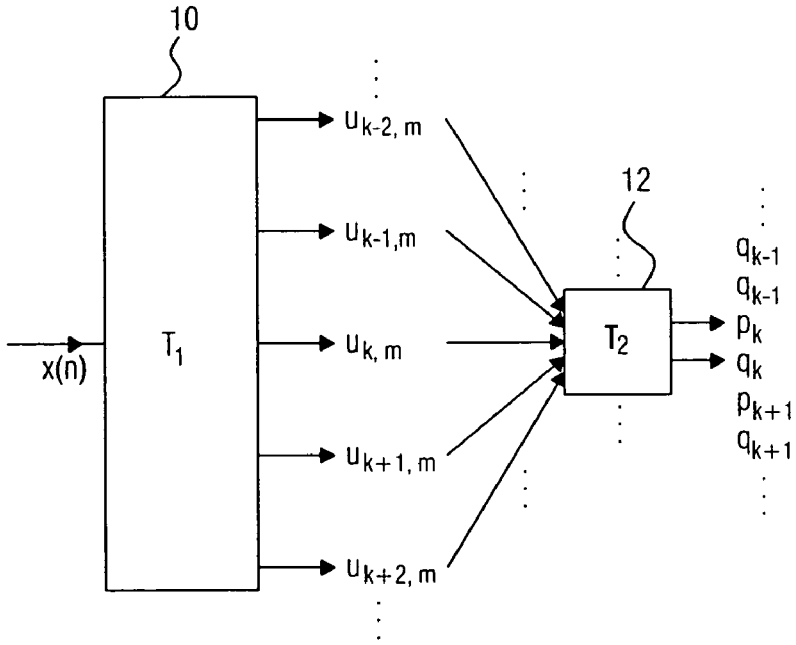
FIG. 3 is a schematic illustration for calculating complex sub-band signals with a real-valued transform $T_1$ and a post-processing transform $T_2$.

FIG. 3 shows an alternative illustration of the device for generating a complex spectral representation, the discrete-time input signal x(n) being fed to the means 10 for generating a block-wise real spectral representation, which in FIG. 3 is referred to as $T_1$. It is to be pointed out that this is a first conversion of the time signal having been windowed to be present in a block-wise form, into a spectral representation at the output of means 10. FIG. 3 shows a snapshot at the time or block index m, i.e. refers to FIG. 2*b*, which has been described above. The output values of the means 10, i.e. the real-valued spectral coefficients, which may, for example, be MDCT coefficients, are fed to means 12 for post-processing in order to obtain a complex spectrum on the output side which includes a first partial spectral coefficient $p_{k,m}$ and a second partial spectral coefficient $q_{k,m}$ for each frequency index k, $p_{k,m}$ being the real part and $q_{k,m}$ being the imaginary part of the complex spectral coefficient for the frequency index k, m relating to the block index.

According to the invention, real-valued transforms in the form of modulated filter banks are employed for the actual spectral separation in order to generate complex-valued spectral components. The real spectral coefficients from temporally successive and/or spectrally adjacent output values of the real-valued transform are used, which in FIG. 3 is referred to by $T_1$ or 10. A real and an imaginary part p, q for a certain frequency index and for a certain (temporal) block index are for example formed thereof. Alternatively, magnitude and phase can of course also be generated. Here, special phase relations of the modulation functions which are the basis for a modulated filter bank can be made use of.

In a preferred embodiment, the operation $T_2$ or 12, being downstream of the first transform, in turn is an invertible critically sampled transform. Thus, the result is an overall system also comprising the characteristic of the critical sampling and at the same time allowing a reconstruction from the spectral components obtained.

$T_2$ is a two-dimensional transform since in the preferred embodiment of the present invention, both temporally adjacent and frequency-adjacent real-valued spectral coefficients are combined, i.e. since the input values thereof are along the time and the frequency axes, as has been illustrated relating to FIGS. 2*a* to 2*c*. Since one respective real and one respective imaginary part result from each transform operation using the means 12, a pair of values, for a critical sampling, need only be calculated for every second sampling position of the time/frequency level. In a preferred embodiment of the present invention, this is obtained by a sampling rate reduction along the time axis, i.e. a calculation for every second block of the first transform $T_1$ only. Alternatively, this is achieved by a sampling rate reduction along the frequency axis, i.e. a calculation for every second sub-band i of the first transform only. As another alternative, this is obtained in an offset way, i.e. in the form of a chequer-board pattern where every second block and every second band are used alternatingly.

The transform coefficients of the second transform by means of which the output values of $T_1$ are weighted before being summarized, i.e. the weighting factors, preferably fulfill the conditions for the exact reconstruction according to the respective sampling scheme. The inventive system includes a number of degrees of freedom which can be employed for optimizing the characteristics of the entire system, i.e. for optimizing the frequency response of the entire system as a complex filter bank.

It is also to be pointed out that the critical sampling may not be required necessarily for some applications. This can, for example, apply in the case of a post-processing of the signal decoded but not yet re-transformed to the time domain in an audio decoder. In this case, there is a higher degree of freedom when choosing the transform coefficients in $T_2$. This higher degree of freedom is preferably employed for a better optimization of the overall performance.

Subsequently, a first embodiment of the present invention for the detailed rule of means 12 for post-processing will be discussed referring to FIG. 4. It is preferred to differentiate between an even frequency index k and an odd frequency index k+1. In the case of an even frequency index, i.e. when $p_{k,m}$ and $q_{k,m}$ are to be calculated (m being the block index and k being the frequency index), the real part $p_{k,m}$ is determined according to the first embodiment of the present invention by a summation of two temporally successive real-valued spectral coefficients. $p_{k,m}$ is thus either formed by the summation of the spectral coefficients with the index k from FIGS. 2*b* and 2*a* or from FIGS. 2*c* and 2*b*.

The pertaining imaginary part $q_{k,m}$ is inventively obtained by summing two successive value with a frequency index of k−1 again either of FIGS. 2*a*, 2*b* (block m−1 and block m) or of FIGS. 2*b* and 2*c* (block m and block m+1).

For an odd frequency index k+1, the real part $p_{k+l,m}$ is calculated as the difference of two successive values, i.e. the difference between the spectral coefficients k+1 of FIGS. 2*a*, 2*b* or FIGS. 2*b*, 2*c*. The pertaining imaginary part $q_{k+1,m}$ results from the difference of two successive values with the frequency index k, i.e. the difference of the real-valued spectral coefficients with the index k of FIGS. 2*a*, 2*b* or FIGS. 2*b*, 2*c*.

Figure 4:
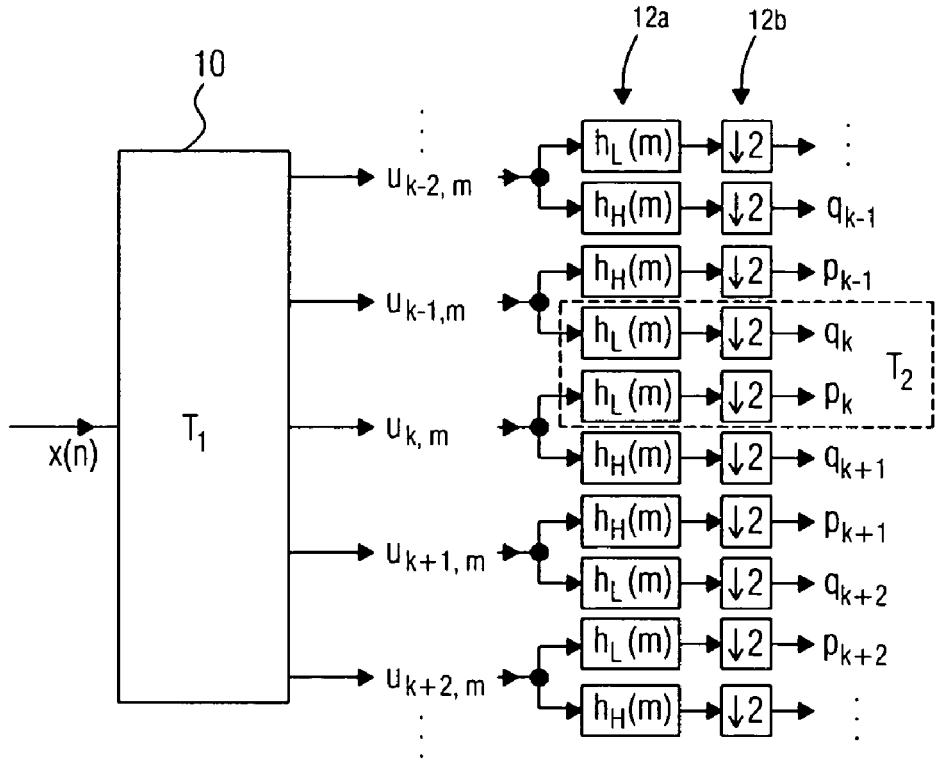
FIG. 4 shows a block diagram of the inventive device according to a preferred embodiment of the present invention with critical sampling.

The result is the transform function illustrated in FIG. 4, as a whole being referred to by the reference numeral 12*a*, the transform function comprising two transform sub-rules $h_L(m)$ and $h_H(m)$ which, as is shown in FIG. 4, are applied alternatingly and in pairs to the output values of means 10. In particular, the first sub-function $h_L(m)$ has the form {1, 1}, whereas the second sub-function includes the form {1, −1}. The notation of the sub-functions $h_L(m)$ and $h_H(m)$ is to indicate that a sum or a difference of the corresponding spectral coefficients is to be formed of two (temporally) adjacent blocks.

The critical sampling can be obtained by a temporal sampling rate reduction by the factor 2, as is symbolically illustrated in FIG. 4 by means 12*b*. If an orthogonality of the second transform (12*a*, 12*b*) is desired, all the output values p, q may be normalized by multiplication by a factor of $1/\sqrt{2}$.

The second transform (12*a*, 12*b*) downstream of the first transform which, for example, is an MDCT, embraces the two adjacent bands from which the real part $p_{k,m}$ and the imaginary part $q_{k,m}$ for a frequency index k are formed. Furthermore, as is illustrated by the functions $h_L$ and $h_H$, temporally successive real-valued spectral coefficients are taken into consideration when combining, i.e. when forming the sum or difference.

Since in the embodiment shown in FIG. 4 the downstream transform 12*a*, 12*b* does not include degrees of freedom for optimizing the overall system as regard adjustable weighting factors contained in the functions $h_L$ and $h_H$, it is preferred to manipulate, i.e. to change compared to a predetermined well-known window function, the window function of the first transform, i.e., for example, of the MDCT, for optimizing the entire system. Here, the result is a degree of freedom of N/2 with a frequency resolution of N sub-bands and a window length of L=2 N values.

In summary, the transform rule $T_2$ illustrated in FIG. 4 is as follows:

for k even:

$$p_{k,m}=u_{k,m}+u_{k,m-1} \tag{1}$$

$$q_{k,m}=u_{k-1,m}+u_{k-1,m-1} \tag{2}$$

for k+1:

$$p_{k+1,m}=u_{k+1,m}-u_{k+1,m-1} \tag{3}$$

$$q_{k+1,m}=u_{k,m}-u_{k,m-1} \tag{4}$$

For canceling the transform $T_2$, as is exemplarily illustrated for FIG. 4 in equations (1) to (4), a transform rule $T_2^{-1}$ inverse to the transform rule $T_2$ is used. When equations (1) to (4) are considered, the result is that the real spectral components $u_{k,m-1}$ and $u_{k,m}$ can be calculated from the real part $p_{k,m}$ and the imaginary part $q_{k+1,m}$, i.e. from equations (1) and (4), by solving the two equations (1) and (4), for two unknown variables, for the real spectral coefficients $u_{k,m-1}$ and $u_{k,m}$ sought. Using this inverse combination rule $T_2^{-1}$, a sequence of real spectral coefficients can be calculated back, knowing the sequence of blocks of complex approximated spectral coefficients, by performing the inverse combination rule.

Subsequently, an alternative embodiment where there is no critical sampling, will be described referring to FIG. 5. Here, the output value $u_{k,m}$ of the $m^{th}$ MDCT operation with the frequency index k is taken directly to form the real part. The pertaining imaginary part is calculated as the weighted sum of the surrounding MDCT output values in the time-frequency level, $u_{k-1,m-1}$, $u_{k-1,m}$, $u_{k-1,m+1}$, $u_{k,m-1}$, $u_{k,m+1}$, $u_{k+1,m-1}$, $u_{k+1,m}$ and $u_{k+1,m+1}$. A possible combination of the corresponding filters according to FIG. 5 (in the case of an odd k) is as follows:

for the real part p:

$$h_R(m)=\{0, 1, 0\},$$

for the imaginary part q:

$$h_A(m)=\{a, -b, a\},\ h_B(m)=\{c, 0, -c\},\ h_c(m)=\{a, b\ a\}$$

In the above expression, the values of the coefficients a, b and c can be taken for optimizing the entire system, i.e. for obtaining a desired frequency response of the overall assembly, which, as has been explained above, is, for example, desired in that there is a band-pass characteristic as a frequency response for positive frequencies, whereas the largest possible attenuation is desired for negative frequencies.

Expressed in the form of an equation, the transform rule $T_2$, illustrated in FIG. 5, including the individual filters 50*a*, 50*b*, 50*c*, 50*d* and a summer 50*e*, is as follows:

for k odd:

$$p_{k,m} = u_{k,m}; \tag{5}$$

$$\begin{aligned} q_{k,m} = {} & a\cdot u_{k-1,m+1} - b\cdot u_{k-1,m} + a\cdot u_{k-1,m-1} + \\ & -c\cdot u_{k,m+1} + c\cdot u_{k,m-1} + a\cdot u_{k+1,m+1} + b\cdot u_{k+1,m} + a\cdot u_{k+1,m-1}; \end{aligned} \tag{6}$$

All the real spectral coefficients adjacent to the real spectral coefficient $u_{k,m}$ in the time-frequency level, weighted by the weighting factors a, b, c to a lesser or greater extent, are used for calculating $q_{k,m}$, as is illustrated in equation (6).

It is to be pointed out that the same equations (4) to (6) may be used for an even k. In this case, the weighting factors preferably have the same magnitudes but partly different signs.

Figure 5:
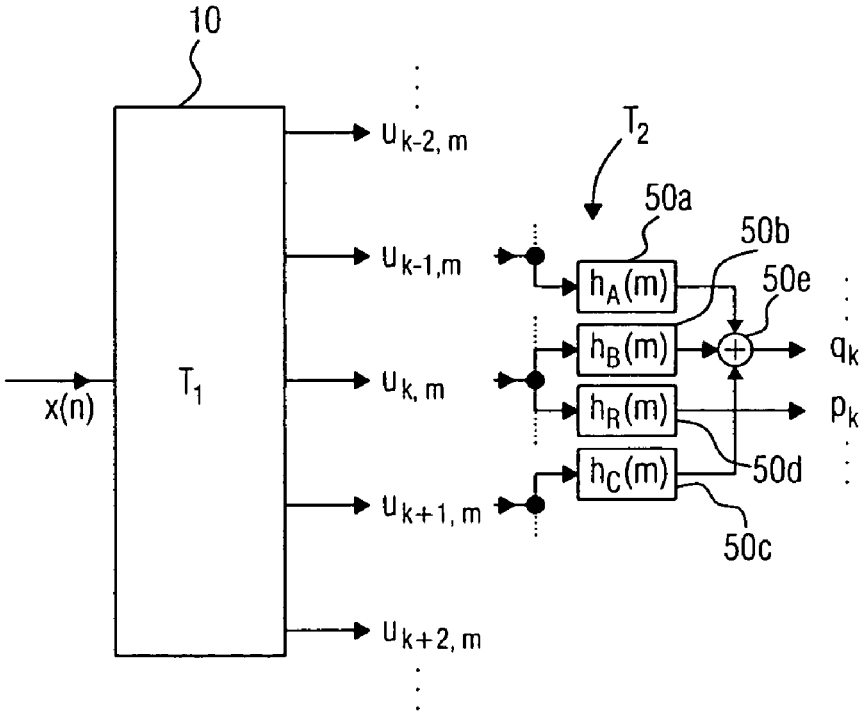
FIG. 5 shows a block diagram of the inventive device according to another embodiment of the present invention without critical sampling.
Figure 6:
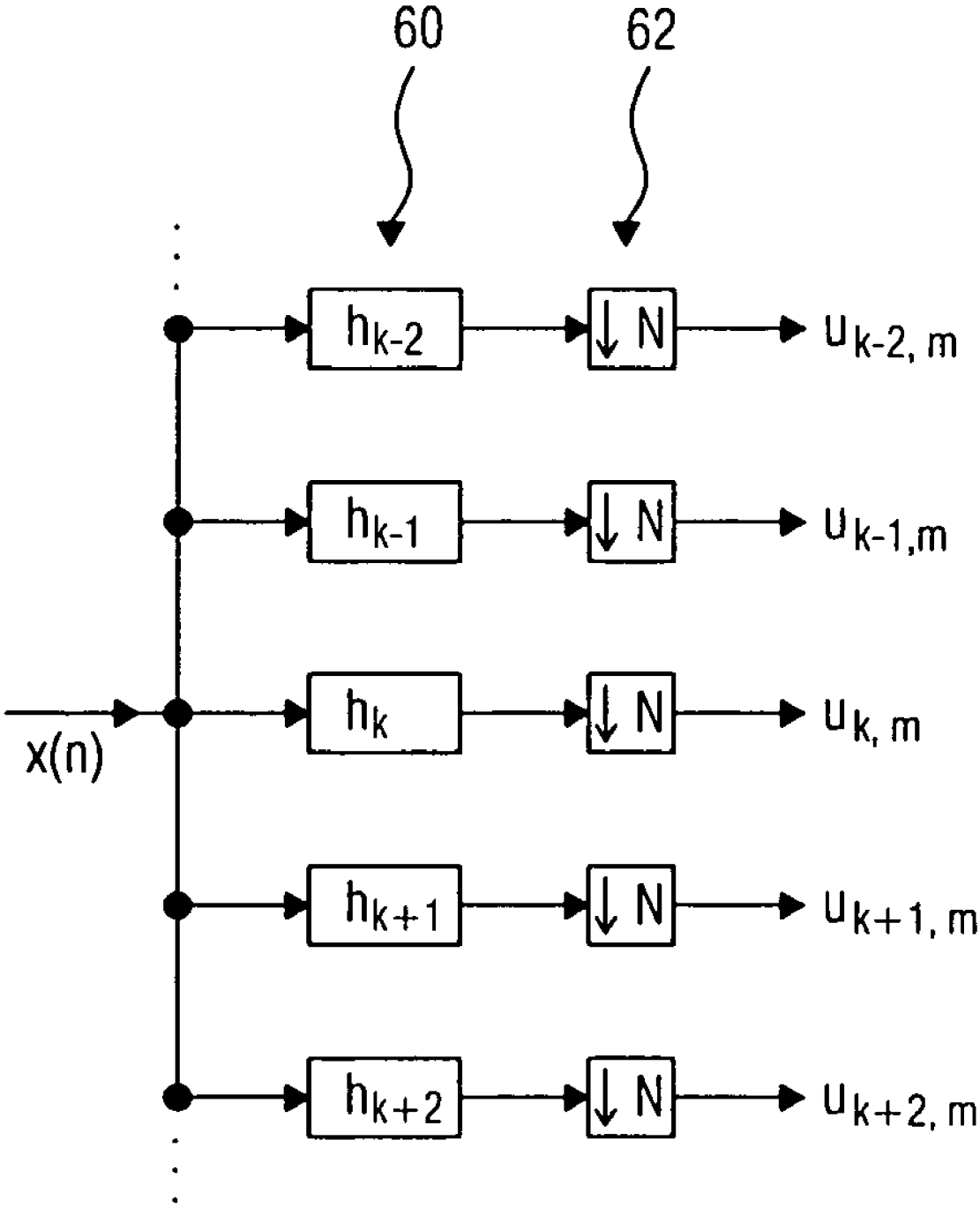
FIGURE 6 (PRIOR ART)
FIG. 6 shows a well-known real-valued filter bank with a uniform band separation.

For reversing the transform rule illustrated in FIG. 5, only one trivial operation must be performed for determining $u_{k,m}$ since this value directly results from equation (5). Because the system shown in FIG. 5 is a non-critically sampled system, the real and the imaginary part are, as far as information is concerned, represented in a redundant way. In the inverted transform rule $T_2^{-1}$ this has the effect that the real spectral coefficients can be calculated from the real parts alone. Equation (6) thus need not be considered for evaluation. In the embodiment shown in FIG. 5, the transform rule inverse to the transform rule thus is identical and given by equation (5).

It is to be pointed out that in the case described herein before where the complex approximated spectral representation, for example, is required in a psycho-acoustic model to adjust the quantizing step size in a coder, a calculation back from the complex approximated spectral representation to the real spectral representation is no longer required. Alternatively, there might be cases where a corresponding inversion is required, i.e. where the underlying real spectral representation must be calculated from the complex approximated spectral representation.

Depending on the circumstances, the inventive method can be implemented in either hardware or software. The implementation can be on a digital storage medium, in particular on a floppy disc or a CD having control signals which can be read out electronically, which cooperate with a programmable computer system such that the corresponding method will be executed. In general, the invention also includes a computer program product having a program code stored on a machine-readable carrier, for performing one or several of the inventive methods when the computer program product runs on a computer. Put differently, the invention also entails a computer program having a program code for performing one or several of the methods when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. Audio encoder for generating an encoded audio signal, the audio encoder comprising:

a device for generating a complex audio spectral representation of a discrete-time audio signal, the device comprising:

a generator for generating a block-wise real-valued audio spectral representation of the discrete-time audio signal, the audio spectral representation comprising temporally successive blocks, each block comprising a set of real audio spectral coefficients; and a post-processor for post-processing the block-wise real-valued audio spectral representation to obtain a block-wise complex approximated audio spectral representation comprising successive blocks wherein the complex approximated audio spectral representation represents the discrete-time audio signal, each block comprising a set of complex approximated audio spectral coefficients, wherein a complex approximated audio spectral coefficient is represented by a first partial audio spectral coefficient and a second partial audio spectral coefficient, wherein at least one of the first and the second partial audio spectral coefficients is determined by combining at least two temporally and/or frequency-adjacent real audio spectral coefficients;

a psycho-acoustic module for calculating a psycho-acoustic masking threshold using the block-wise complex approximated audio spectral representation; and a quantizer for quantizing the block-wise real-valued audio spectral representation using the psycho-acoustic masking threshold to obtain the encoded audio signal.

2. Audio encoder according to claim 1, wherein the first partial audio spectral coefficient is a real part of the complex approximated audio spectral coefficient and the second partial audio spectral coefficient is an imaginary part of the complex approximated audio spectral coefficient.

3. Audio encoder according to claim 1, wherein the combination is a linear combination.

4. Audio encoder according to claim 1, wherein the post-processor for post-processing is formed to combine a real audio spectral coefficient of the frequency and a real audio spectral coefficient of an adjacent higher or lower frequency for determining a complex audio spectral coefficient.

5. Audio encoder according to claim 1, wherein the post-processor for post-processing is formed to combine a real audio spectral coefficient in a current block and a real audio spectral coefficient in a temporally preceding block or a temporally subsequent block for determining a complex audio spectral coefficient of a certain frequency.

6. Audio encoder according to claim 1, in which the device is formed to operate, in a critical sampling, such that a real audio spectral value is generated for each discrete-time audio sample value by the generator for generating a block-wise real audio spectral representation and that a complex spectral coefficient is generated for two real audio spectral coefficients.

7. Audio encoder according to claim 6, wherein the post-processor for post-processing is formed to only be active for every second block of real-valued audio spectral coefficients to reduce a sampling rate or to be active for every second real audio spectral coefficient to reduce the sampling rate or to only be active for every second block or for every second real audio spectral coefficient alternating to reduce the sampling rate.

8. Audio encoder according to claim 1, wherein the post-processor for post-processing is formed to sum two real audio spectral coefficients having the same frequency index from a current block and from a temporally preceding block for the first partial audio spectral coefficient having an even frequency index, and to sum two real audio spectral coefficients having a frequency index lower by 1 from the current block and the temporally preceding block for the second partial audio spectral coefficient having the even frequency index.

9. Audio encoder according to claim 1, wherein the post-processor for post-processing is formed to form a difference of two real audio spectral coefficients having an odd frequency index from a current block and from a temporally preceding block for the first partial audio spectral coefficient having the odd frequency index, and to form a difference of two real audio spectral coefficients having a frequency index lower by 1 from the current block and the temporally preceding block for the second partial audio spectral coefficient.

10. Audio encoder according to claim 1, wherein the post-processor for post-processing is formed to normalize the first and second partial audio spectral coefficients each by a factor of $1/\sqrt{2}$.

11. Audio encoder according to claim 1, wherein the post-processor for post-processing is formed to use a real audio spectral coefficient having a frequency index as the first partial audio spectral coefficient for the frequency index, and to use a weighted sum of the real audio spectral coefficients having adjacent frequency indices of a current block, from one or several preceding blocks or from one or several subsequent blocks for calculating the second partial audio spectral coefficient, at least two weighting factors being unequal to 0.

12. Audio encoder according to claim 11, wherein the post-processor for post-processing is formed not to use the real audio spectral coefficient forming the first partial audio spectral coefficient for calculating the second partial audio spectral coefficient.

13. Audio encoder according to claim 11, wherein the post-processor for post-processing is formed to apply the following rule for calculating the second audio spectral coefficient:

$$q_{k,m} = a \cdot u_{k-1,m+1} - b \cdot u_{k-1,m} + a \cdot u_{k-1,m-1} + -c \cdot u_{k,m+1} + c \cdot u_{k,m-1} + a \cdot u_{k-1,m-1} + b \cdot u_{k+1,m} + a \cdot u_{k+1,m-1};$$

a, b, c being positive or negative weighting factors, k−1 being a current frequency index k minus 1, m−1 being a current block index m minus 1, k+1 being a current frequency index k plus 1, m+1 being a current block index m plus 1 and $u_{k-1,m-1}$ being a real audio spectral coefficient of a temporally preceding block having a frequency index k−1, $u_{k-1,m}$ being a real audio spectral coefficient of a current block having a frequency index k−1, $u_{k-1,m+1}$ being a real audio spectral coefficient of a temporally subsequent block having a frequency index k−1, $u_{k,m-1}$ being a real audio spectral coefficient having the frequency index of k from the temporally preceding block, $u_{k,m+1}$ being a real audio spectral coefficient having the frequency index for the temporally subsequent block, $u_{k+1,m-1}$ being a real audio spectral coefficient having the frequency index k+1 from the temporally preceding block, $u_{k+1,m}$ being a real audio spectral coefficient for the frequency index k+1 from the current block and $u_{k+1,m+1}$ being a real audio spectral coefficient having the frequency index k+1 from the temporally subsequent block.

14. Audio encoder according to claim 13, wherein the signs from one or several weighting factors are different for even and odd frequency indices k.

15. Audio encoder according to claim 13, wherein the weighting factors are adjusted to provide a desired frequency response for the device for generating a complex audio spectral representation.

16. Audio encoder according to claim 1, wherein the generator for generating is formed to execute a modified discrete cosine transform.

17. Audio encoder according to claim 16, wherein the generator for generating is formed to execute a modified discrete cosine transform with a window overlapping of 50%.

18. A computer-implemented method for generating an encoded audio signal the method comprising:

a method for generating a complex audio spectral representation of a discrete-time audio signal, comprising:

generating with a processor a block-wise real-valued audio spectral representation of the discrete-time audio signal, the audio spectral representation comprising temporally successive blocks, each block comprising a set of real audio spectral coefficients; and post-processing with a processor the block-wise real-valued audio spectral representation to obtain a block-wise complex approximated audio spectral representation comprising successive blocks wherein the complex approximated audio spectral representation represents the discrete-time audio signal, each block comprising a set of complex approximated audio spectral coefficients, wherein a complex approximated audio spectral coefficient is represented by a first partial audio spectral coefficient and a second partial audio spectral coefficient, wherein at least one of the first and second partial audio spectral coefficients is determined by combining at least two temporally and/or frequency-adjacent real audio spectral coefficients;

calculating with a processor a psycho-acoustic masking threshold using the block-wise complex approximated audio spectral representation; and quantizing with a processor the block-wise real-valued audio spectral representation using the psycho-acoustic masking threshold to obtain the encoded audio signal.

19. A device for coding a discrete-time audio signal to obtain an encoded audio signal, comprising:

a generator for generating a block-wise real-valued audio spectral representation of the discrete-time audio signal, the audio spectral representation comprising temporally successive blocks, each block comprising a set of real audio spectral coefficients a psycho-acoustic module for calculating a psycho-acoustic masking threshold;

a quantizer for quantizing a block of real-valued audio spectral coefficients using the psycho-acoustic masking threshold to obtain the encoded audio signal, wherein the psycho-acoustic module comprises a post-processor for post-processing the block-wise real audio spectral representation to obtain a block-wise complex approximated audio spectral representation comprising successive blocks, each block comprising a set of complex approximated audio spectral coefficients, wherein a complex approximated audio spectral coefficient is represented by a first partial audio spectral coefficient and a second partial audio spectral coefficient, wherein at least one of the first and second partial audio spectral coefficients is determined by combining at least two temporally and/or frequency-adjacent real audio spectral coefficients, and wherein the psycho-acoustic module is adapted to calculate the psycho-acoustic masking threshold based on the block-wise complex approximated audio spectral representation.

20. A computer-implemented method for coding a discrete-time audio signal to obtain an encoded audio signal, comprising:

generating with a processor a block-wise real-valued audio spectral representation of the discrete-time audio signal, the audio spectral representation comprising temporally successive blocks, each block comprising a set of real audio spectral coefficients;

calculating with a processor a psycho-acoustic masking threshold; and quantizing with a processor a block of real-valued audio spectral coefficients using the psycho-acoustic masking threshold to obtain the encoded audio signal, wherein a step of post-processing the block-wise real audio spectral representation is performed in the step of calculating to obtain a block-wise complex approximated audio spectral representation comprising successive blocks, each comprising a set of complex approximated audio spectral coefficients, wherein a complex approximated audio spectral coefficient is represented by a first partial audio spectral coefficient and a second partial audio spectral coefficient, wherein at least one of the first and second partial audio spectral coefficients is determined by combining at least two temporally and/or frequency-adjacent real audio spectral coefficients, and wherein the psycho-acoustic masking threshold is calculated based on the block-wise complex approximated audio spectral representation.

21. A digital storage medium having stored thereon computer program code for performing a method for generating an encoded audio signal, the method comprising:

a method for generating a complex audio spectral representation of a discrete-time audio signal, the method comprising:

generating a block-wise real-valued audio spectral representation of the discrete-time audio signal, the audio spectral representation comprising temporally successive blocks, each block comprising a set of real audio spectral coefficients; and post-processing the block-wise real-valued audio spectral representation to obtain a block-wise complex approximated audio spectral representation comprising successive blocks, each block comprising a set of complex approximated audio spectral coefficients, wherein a complex approximated audio spectral coefficient is represented by a first partial audio spectral coefficient and a second partial audio spectral coefficient, wherein at least one of the first and second partial audio spectral coefficients is determined by combining at least two temporally and/or frequency-adjacent real audio spectral coefficients;

calculating a psycho-acoustic masking threshold using the block-wise complex approximated audio spectral representation; and quantizing the block-wise real-valued audio spectral representation using the psycho-acoustic masking threshold to obtain the encoded audio signal, when the computer program code runs on a computer.

22. A digital storage medium having stored thereon computer program code for performing a method for coding a discrete-time audio signal, the method comprising:

generating a block-wise real-valued audio spectral representation of the discrete-time audio signal, the audio spectral representation comprising temporally successive blocks, each block comprising a set of real audio spectral coefficients;

calculating a psycho-acoustic masking threshold;

quantizing a block of real-valued audio spectral coefficients using the psycho-acoustic masking threshold to obtain the encoded audio signal, wherein a step of post-processing the block-wise real audio spectral representation is performed in the step of calculating to obtain a block-wise complex approximated audio spectral representation comprising successive blocks, each comprising a set of complex approximated audio spectral coefficients, wherein a complex approximated audio spectral coefficient is represented by a first partial audio spectral coefficient and a second partial audio spectral coefficient, wherein at least one of the first and second partial audio spectral coefficients is determined by combining at least two temporally and/or frequency-adjacent real audio spectral coefficients, wherein the psycho-acoustic masking threshold is calculated based on the block-wise complex approximated audio spectral representation, when the computer program code runs on a computer.

* * * * *